US007309195B2

(12) United States Patent
Kleine et al.

(10) Patent No.: US 7,309,195 B2
(45) Date of Patent: Dec. 18, 2007

(54) SHANK FOR A ROTARY AND/OR PERCUSSIVE TOOL

(75) Inventors: Werner Kleine, Achim (DE); Hans-Werner Bongers-Ambrosius, Laupheim (DE); Josef Obermeier, Peiting (DE); Werner Britten, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 426 days.

(21) Appl. No.: 10/600,035

(22) Filed: Jun. 20, 2003

(65) Prior Publication Data

US 2004/0052596 A1 Mar. 18, 2004

(30) Foreign Application Priority Data

Jun. 21, 2002 (DE) ..... 102 27 897

(51) Int. Cl.
*B25D 17/08* (2006.01)

(52) U.S. Cl. ..... 408/226; 408/240; 279/75; 175/395

(58) Field of Classification Search ..... 408/226, 408/239 R, 240; 175/320, 395; 279/75; *B25D 17/08*
See application file for complete search history.

(56) References Cited

U.S. PATENT DOCUMENTS

| | | | | |
|---|---|---|---|---|
| 3,982,846 A | | 9/1976 | Steinbach | |
| 4,006,787 A | * | 2/1977 | Rumpp et al. | 173/132 |
| 5,984,596 A | * | 11/1999 | Fehrle et al. | 408/226 |
| 6,116,827 A | * | 9/2000 | Moser et al. | 408/204 |
| 2004/0144568 A1 | * | 7/2004 | Van Dijk | 175/57 |
| 2004/0164501 A1 | * | 8/2004 | Gotzfried | 279/20 |
| 2005/0072600 A1 | * | 4/2005 | Kleine et al. | 175/320 |

FOREIGN PATENT DOCUMENTS

| | | | |
|---|---|---|---|
| DE | 2750219 A1 | * | 5/1979 |
| DE | 3042319 A1 | * | 6/1982 |
| DE | 3905286 C1 | * | 5/1990 |
| DE | 9604280 | | 8/1997 |
| DE | 19604280 A1 | * | 8/1997 |
| DE | 10057124 A1 | * | 5/2001 |
| EP | 0064735 | | 11/1982 |
| EP | 304002 A1 | * | 2/1989 |
| EP | 0351486 | | 1/1990 |
| FR | 2488179 A1 | * | 7/1981 |

OTHER PUBLICATIONS

PTO 06-1695, translation of European Patent No. 0 304 002 A1, translated Jan. 2006 by the McElroy Translation Company, 12 pages including the title page.*

* cited by examiner

*Primary Examiner*—Monica Carter
*Assistant Examiner*—Eric A. Gates
(74) *Attorney, Agent, or Firm*—Abelman, Frayne & Schwab

(57) ABSTRACT

A shank for a rotary and percussive tool has a locking groove (3) arranged between two guided regions (1*a*, 1*b*) and axially closed at its opposite ends for receiving at least one radially displaceable and axially displaceable, within predetermined limits, locking member (4) of a chuck in which the shank is received, with the guide dimension (F) of the guide region being smaller than the width (B) of the axial region (A) of the locking groove (3) and that includes the radial extent of an entrain strip (2) provided in that region (A), and greater than the thickness (D) of the axial region measured in a direction transverse to the width measurement direction.

18 Claims, 4 Drawing Sheets

SHANK FOR A ROTARY AND/OR PERCUSSIVE TOOL

BACKGROUND OF THE INVENTION

1. Field of the Invention

The present invention relates to a shank for a rotary and/or percussive tool such as trepan, chisel, or annular bit with a diameter up to 150 mm for working stone, concrete, or brickwork, and a chuck for receiving the shank.

2. Description of the Prior Art

Generally, a rotary and percussive tool has a shank with round guide regions, axially closed locking grooves, and entrain grooves open at their power tool side, with radially displaceable locking elements of a chuck, in which the shank is received, engaging in the locking grooves and limiting the axial displacement of the working tool. The radially inwardly located, with respect to the outer surfaces of the guide region, entrain surfaces require, because of their small radial depth, high surface pressures for transmitting a torque. This leads to an early or premature wear of these surfaces. Furthermore, because such grooves are formed by machining in a round shank, the cross-sectional surface available for transmission of impacts to the working tool is reduced.

U.S. Pat. No. 2,047,125 discloses a shank for a rotary and percussive tool and which has a plurality of axially offset, radially projecting entrain surfaces having a rectangular or trapezoidal cross-section.

U.S. Pat. No. 5,984,596 discloses a shank for a rotary and percussive tool having a locking groove for receiving a locking member radially engaging therein, and two diametrically opposite, radially projecting, rhomboidal entrain surfaces. In the discloses shank, there is a sharp transition from the round guide regions to the entrain surfaces. This leads, at an impact load, to reflection of a generated load pulse and, thus, to a reduced drilling capacity of the tool. In addition, the manufacture of such shanks is time-consuming and expensive.

French Patent No. 2,408,716 discloses a shank with radially projecting entrain strips which for limiting axial displacement, have their axial end surfaces being contacted by locking elements of a chuck. The entrain strips are obtained by deforming the shank with round guide regions. With locking being effected by contact with the radially outer end surfaces of the entrain strips, a relatively large radial depth of the chuck, with respect to the diameter of the shank, is required. The pressed-in grooves with an acute angle and small axial stop surfaces are not suitable for properly engaging the locking elements.

Accordingly, an object of the present invention is to provide a shank for a rotary and percussive tool capable of transmitting a high torque without any noticeable wear from a chuck having a relatively small radial depth, and having good pulse behavior.

A further object of the invention is to provide a shank of a type described above that can be formed with using less material and in a shorter time than a conventional chuck.

SUMMARY OF THE INVENTION

These and other objects of the present invention, which will become apparent hereinafter, are achieved by providing a shank having at least two, axially spaced, guide regions, at least one radially projecting entrain strip, and at least one locking groove arranged between the at least two guide regions and axially closed at its opposite ends for receiving at least one radially displaceable and axially displaceable, within predetermined limits, locking member of a chuck. At least one of the at least two guide regions has a guide dimension that is smaller than a cross-sectional width of an axial region of the locking groove that also includes radial extent of the entrain strip, and greater than a thickness of the axial region measured in a direction transverse to the width measurement direction.

The radially reduced, with respect to the guide dimension, thickness of the locking groove and the radially increased, in the same cross-sectional region, width of the entrain strip mutually compensate the respective surface change, so that a reduced cross-sectional change between the guide region and the axial region of the locking groove is obtained. It is the cross-sectional change that by changing the acoustic impedance of the shank, causes undesirable reflections of the shock pulse wave. Otherwise, the length and the position of the entrain strip with respect to the locking groove are arbitrary selectable.

Advantageously, both the locking groove and the entrain strip have the same length, with the axial region extending, advantageously, over the entire length of the locking groove, which further reduces the cross-sectional change along the shank.

Advantageously, the axial region of the locking groove and the guide region have substantially the same cross-sectional surface within a tolerance range ±10% which permits to form the shank using economical deformation processes used in mass-production such as, e.g., cold-pressing process.

Advantageously, the guide grooves are provided at at least one but, preferably, at both of their ends with a spherical or cylindrical surface(s) engageable by a spherical or roll-shaped locking element, which permits to obtain a surface contact with a reduced wear.

Advantageously, a maximum aperture angle of a bottom surface of the locking groove, which is defined by a cross-section of the axial region of the locking groove, amounts to at least 120°, which provides for an adequately large axial stop surface for the locking grove.

Advantageously, in the axial region of the locking grooves, there are provided two, located diametrically opposite each other, entrain strips, with the bottom surface of a locking groove and respective side surfaces of the two entrain strip forming a functional surface that is formed of smooth surface sections which smoothly pass into each other or form a sharp edge, with the transaction region being curved in a direction to the tool axis. The functional surfaces insure a substantially tension-free transmission of forces applied to the side surfaces of the entrain strip, to the tool.

Advantageously, both diametrically opposite, functional surfaces are substantially identically shaped, whereby a symmetrical, substantially rhomboidal cross-section is produced, and roll-shaped locking elements, which are arranged transverse to the functional surfaces, can linearly roll-up therealong.

Advantageously, at least one guide region but, preferably, both guide regions have a cylindrical outer surface, which permits to achieve a uniform, axially symmetrical guidance of the shank in the chuck and, thereby, a good concentric rotation. In addition, the cylindrical guide surfaces form good sealing surfaces.

Further, providing two, advantageously, diametrically opposite entrain strip permits to transmit to the tool a drive torque, without an axial bending torque, from the chuck.

Advantageously, there are provided in the axial region, two, preferably, diametrically opposite locking grooves.

Thereby, the locking position of the shank in the chuck is always located within a rotational angle of the tool of 180° permitted by the hand anatomy.

Advantageously, the provisions, in the axial region, of two, diametrically opposite, locking grooves, which are identically shaped, and two, diametrically opposite, entrain strips which extend transverse to the plane of the locking grooves, permits to obtain a technologically simple, dual symmetry of the shank and of the associated chuck.

Advantageously, correct dimensions of the shank, with respect to the applied load, are obtained when at the guide dimension F, the width of the axial region B=1.2-1.4×F and the thickness D=0.6-0.8×F.

Advantageously, the guide region has an axial length greater than 5 mm and smaller than 20 mm, optimally 10 mm, which provides for adequate guidance of a short shank.

A substantially wear-free operation of a hammer drill for forming bores with a diameter from 3 mm to 28 mm is obtained when the shank has two guide regions with a diameter of 10 mm, with the axial region of the locking groove, which is provided between the two guide regions, having a width including the entrain strip, of 12 mm and a thickness, in the direction perpendicular to the width measurement direction of 6.5 mm.

A substantially wear-free operation of a hammer drill for forming bores with a diameter from 12 mm to 40 mm is obtained when the shank has two guide regions with a diameter 10 mm, with the axial region of the locking groove provided between the two guide regions, having a width including the entrain strips, of 14 mm and a thickness, in the direction perpendicular to the width measurement direction, of 6 mm.

For a tool set including a first tool with a shank having two guide regions with a diameter of 10 mm, with the axial region of the locking groove provided between the two guide regions, having a width, including the entrain strip, of 12 mm and a thickness, in the direction perpendicular to the width measurement direction, of 6.5 mm; and including a second tool with a shank having two guide regions with a diameter of 10 mm, with the axial region of the locking groove provided between the two guide regions, having a width, including the entrain strips, of 14 mm and a thickness, in the direction perpendicular to the width measurement direction, of 6 mm, a compact cross-section of the axial region of the locking groove with a greater thickness/width ratio insures a one-sided compatibility of a first tool shank with a chuck associated with the shank for the second tool. The tools of this types are used with power tools having a corresponding power, which eliminates overloading of the power tools.

Advantageously, a uniform, axial flexural strength during rotation is achieved when the shank has several axial regions axially spaced from each other and arranged relative to each other in parallel, crosswise, or at an acute angle(s).

Advantageously, bending vibrations are suppressed and quite running is achieved when the shank has a third guide region formed of segments provided between the locking grooves and the entrain strips.

A chuck for receiving the inventive shank includes two axially spaced inner guide surfaces cooperating with the respective guide regions of the shank, at least one locking member radially displaceable over a distance smaller than a half of the guide dimension of the guide regions of the shank, and at least one rotation-transmitting element circumferentially offset relative to the locking member and having a radial extent, with respect to a tool axis, greater than a half of the guide dimension.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1A:
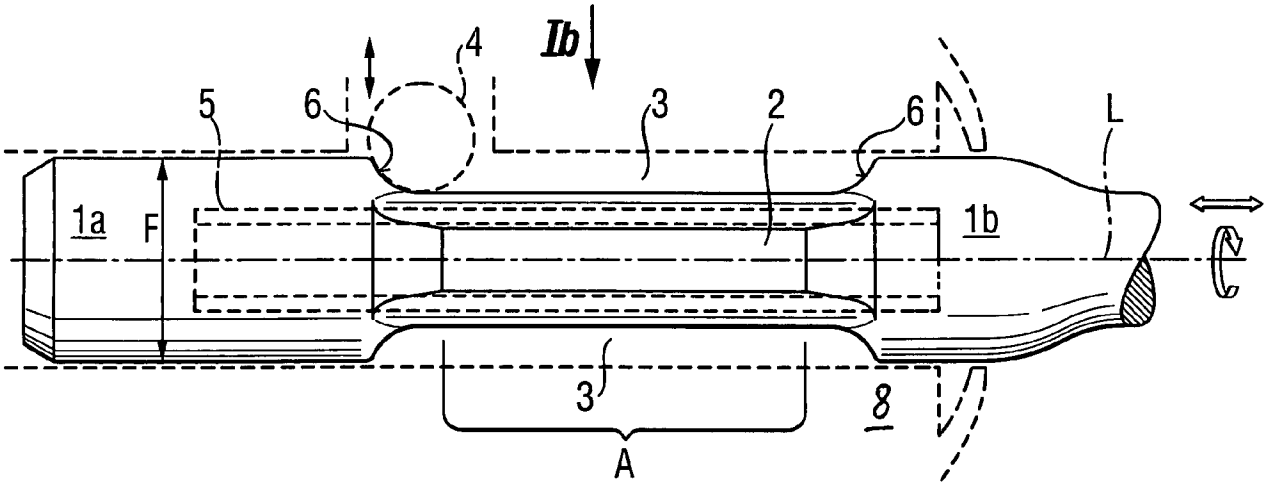
FIG. 1*a* shows a side view of a shank according to the present invention of a rotatable and percussive working tool.
Figure 1C:
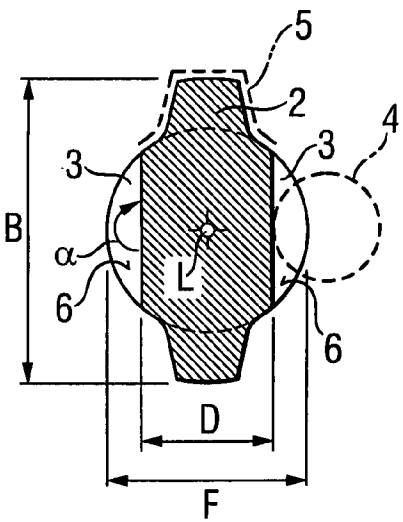
FIG. 1*c* shows a cross-sectional view along line Ic-Ic in FIG. 1*b;*
Figure 1B:
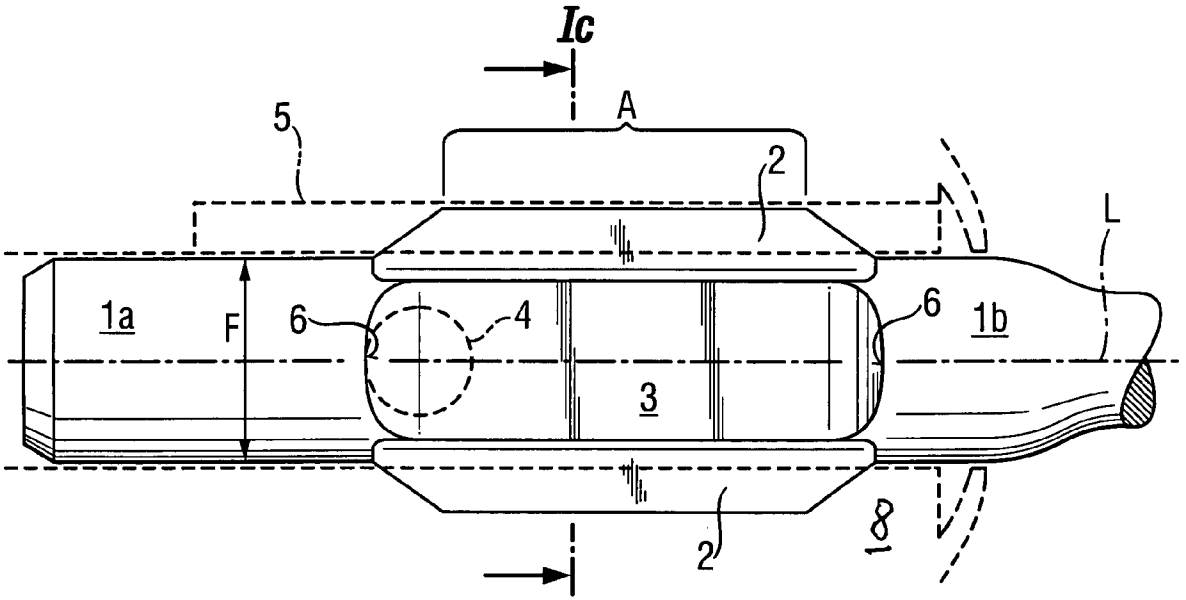
FIG. 1*b* shows a view of the shank in the direction of arrow Ib.

A shank according to the present invention, which is shown in FIGS. 1*a*, 1*b*, and 1*c* has at least two, axially spaced, guide regions 1*a*, 1*b* substantially concentric with respect to the tool longitudinal axis L, two diametrically opposite, radially projecting, entrain strips 2, and two, diametrically opposite, axially closed locking grooves 3 having the same length and located between the opposite guide regions 1*a*, 1*b*. The locking grooves 3 are arranged transversely of the entrain strips 2. The locking grooves 3 are designed for receiving a radially displaceable locking member 4 of a chuck 8 which is shown with dash lines and has axially spaced, inner guide surfaces and rotation transmitting means 5. The locking member 4 is also axially displaceable within predetermined limits. The guide regions 1*a*, 1*b* have a radial dimension F. The axial region A of the locking grooves 3 has a cross-sectional width B, including both entrain strips 2, and a thickness D in the direction perpendicular to the width-measurement direction. The relationship between the dimensions F, B and D is as follows:

$$D<F<B$$

As shown in FIG. 1*c*, the axial region A and the cylindrical regions 1*a*, 1*b* have, at a dual symmetry, the same cross-sectional surface. The locking grooves 3 have, at their opposite ends, spherical or cylindrical axial stop surfaces 6 for the locking member 4. A maximum aperture angle $\alpha$ of the bottom surface of the locking grooves 3, which is measured in the cross-sectional region of the axial region A, amounts to 180°.

Figure 2B:
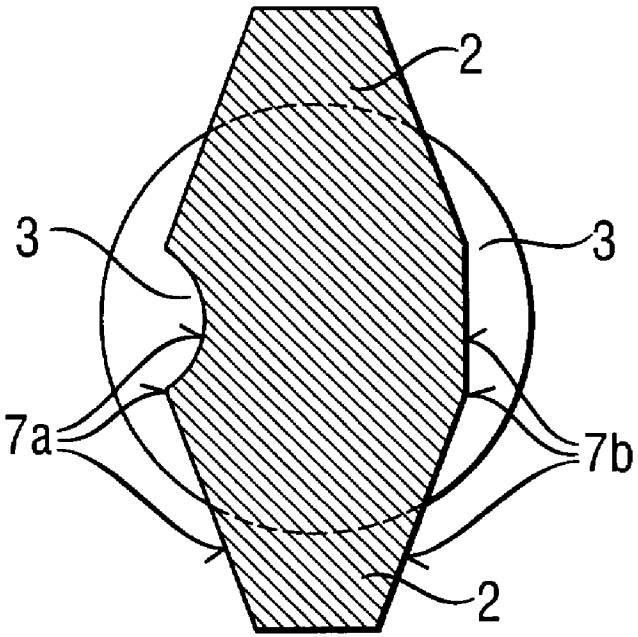
FIG. 2*b* shows a cross-sectional view of yet another embodiment of a shank according to the present invention.
Figure 2A:
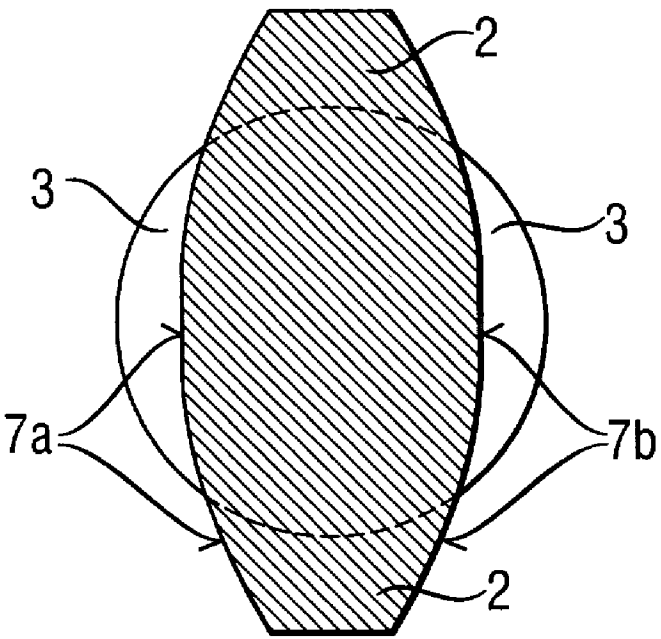
FIG. 2*a* shows a cross-sectional view similar to that of FIG. 1*c* of another embodiment of a shank according to the present invention.

According to FIGS. 2*a*-2*b*, in the cross-sectional region of the locking groove 3, the side surfaces of the two entrain strips 2 and the bottom surfaces of the respective locking grooves 3 form two functional surfaces 7*a*, 7*b*. In the embodiment of FIG. 2*a*, the two diametrically opposite functional surfaces 7*a*, 7*b* have the same profile and a smooth transition region, a curve facing the tool axis. In the embodiment of FIG. 2*b*, the functional surfaces 7*a*, 7*b* are not the same and are formed, respectively, by a straight section and a curved groove section and by two straight sections.

Figure 3A:
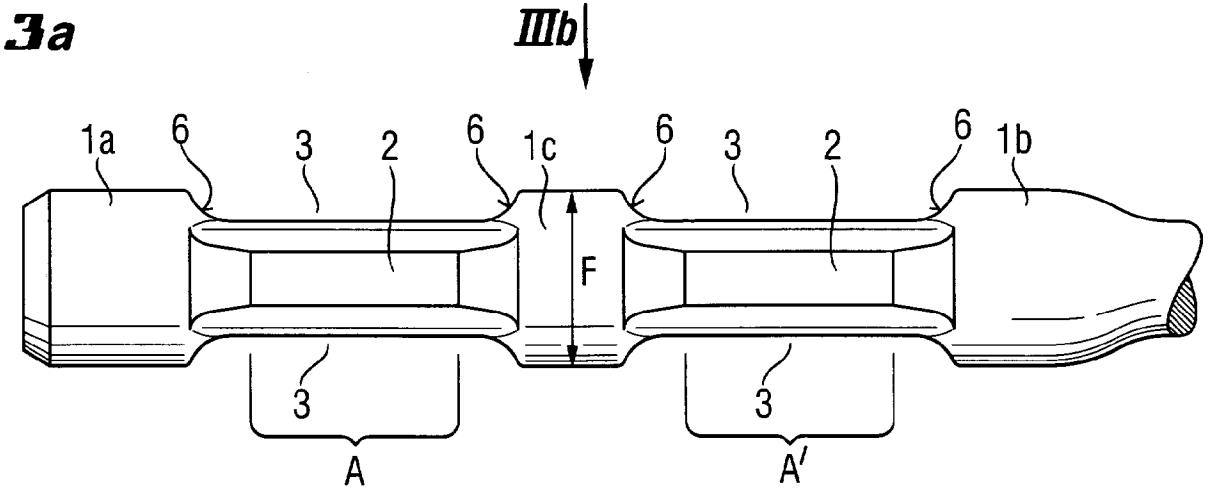
FIG. 3*a* shows a side view of a further embodiment of a shank according to the present invention.
Figure 3B:
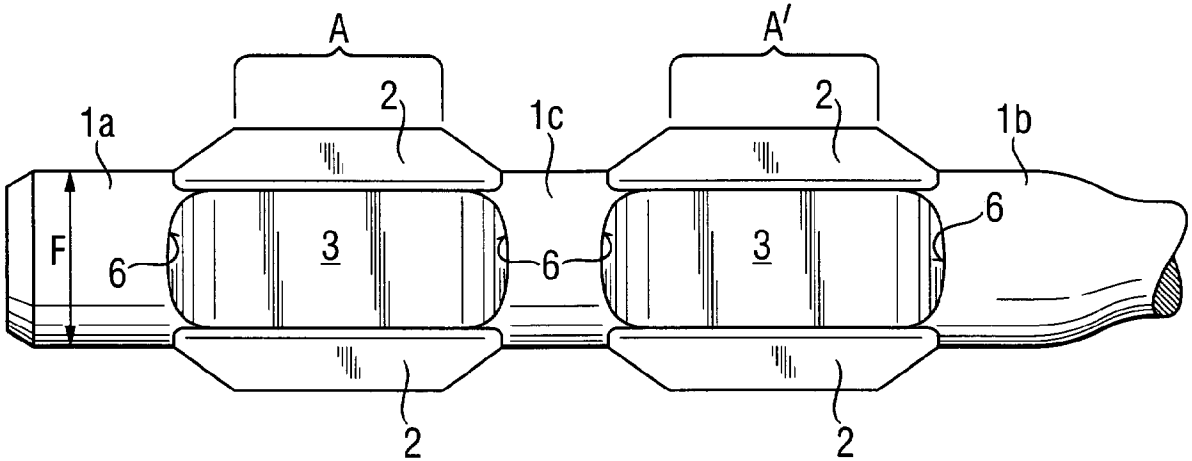
FIG. 3*b* shows a side view of a shank shown in FIG. 3*a* in the direction of arrow IIIb.

In the embodiments of FIG. 3*a*, 3*b*, the shank has two, axially spaced axial regions A, $A^1$, with a third guide region 1*c* provided between the two axial regions A, $A^1$.

Figure 4B:
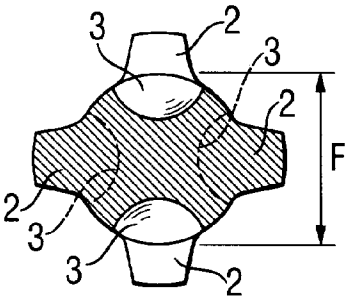
FIG. 4*b* shows a cross-sectional view along line IVb-IVb in FIG. 4*a;*
Figure 4A:
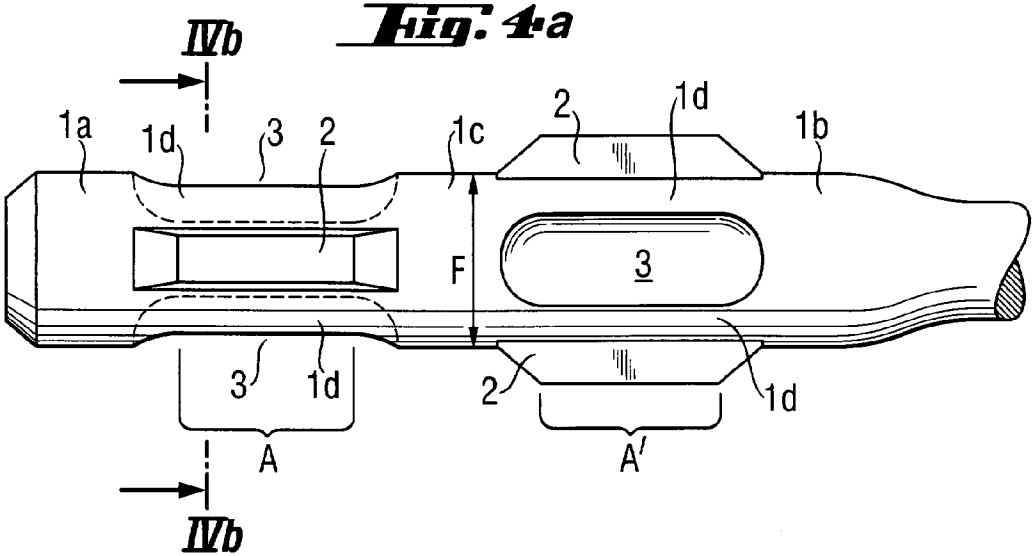
FIG. 4*a* shows a side view of a still another embodiment of a shank according to the present invention.

In the embodiment of FIGS. 4*a*, 4*b*, the shank also has two axially spaced, axial regions A, $A^1$, which, however, are arranged crosswise with respect to each other. Between the two axial regions A, $A^1$, there is provided a third guide region 1*c* having the cross-sectional dimension F. Within the axial regions A, $A^1$, there are provided, between the locking grooves 3 and the entrain strips 2, four circumferentially distributed, guide regions 1*d*. The guide region 1*d* have a shape of a segment of a cylinder and a guide dimension F.

Figure 5B:
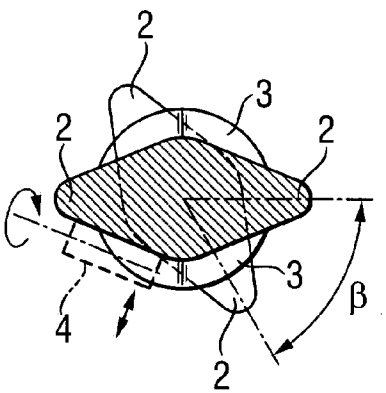
FIG. 5*b* shows a cross-sectional view along line Vb-Vb in FIG. 5*a.*
Figure 5A:
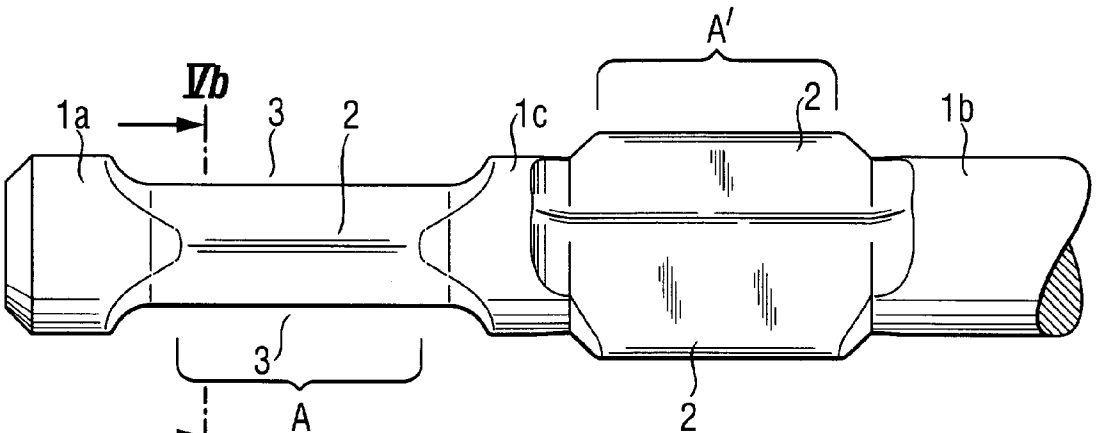
FIG. 5*a* shows a side view of a yet further embodiment of a shank according to the present invention.

In the embodiment of FIGS. 5*a*, 5*b*, two axial regions A and $A^1$ are offset axially and are pivoted with respect to each other by an acute angle β of about 60°. The axial regions A, $A^1$ have substantially a rhomboidal cross-section along which a transversely arranged, roll-shaped, radially displaceable looking member 4 can linearly roll.

An advantageous embodiment of a shank according to the present invention and having a guide region with a guide dimension F, would have a width B=1.2-1.4×F, and a thickness D=0.6-0.8×F, and can be realized in two versions.

I) For a hammer drill for forming bores with a diameter from, 3 mm to 28 mm:

Both guide regions with a guide dimension of 10 mm, would have an axial length of 10 mm, with the axial region of the locking groove provided between the two guide regions, having a width including the entrain strip, of 12 mm and a thickness, in the direction perpendicular to the width measurement direction, of 6.5 mm. These dimensions insure a substantially wear-free operation of the hammer drill in the diameter range from 3 mm to 28 mm.

II) For a hammer drill with a diameter range from 12 mm to 40 mm, chisel power tool, or annular bit:

Both guide regions have an axial length of 20 mm, with the axial region of the locking groove provided between the two guide regions, having a width, including the entrain strips, of 14 mm and a thickness, in the direction perpendicular to the width measurement direction, of 6 mm.

A compact cross-section of the axial region of the locking groove with a greater thickness/width ratio insures a one-sided compatibility of a tool with a shank according to version I with a chuck associated with the shank according to version II.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A shank for a rotary and/or percussive tool, comprising:

at least two, axially spaced, guide regions (1*a*, 1*b*);

at least one radially projecting entrain strip (2) arranged between the at least two guide regions (1*a*, 1*b*); and at least one locking groove (3) arranged between the at least two guide regions (1*a*, 1*b*), the at least one locking groove (3) being axially closed at opposite ends thereof and adapted to receive at least one radially displaceable and axially displaceable, within predetermined limits, locking member (4) of a chuck, wherein the two guide regions (1*a*, 1*b*) have identical diameters equal to a guide dimension (F), and an axial region (A) of the at least one locking groove (3) has a cross-sectional width (B) that includes a radial extent of the entrain strip (2), and a thickness (D) measured in a direction transverse to the width measurement direction, and wherein the guide dimension (F) is greater than the thickness (D) but smaller than the width (B), and wherein a maximum aperture angle (α) of a bottom surface of the at least one locking groove (3), which is defined by a cross-section of the axial region (A) of the at least one locking groove (3), amounts to 180°.

2. A shank according to claim 1, wherein the axial region (A) of the at least one locking groove (3) and at least one of the guide regions (1*a*, 1*b*) have a substantially same cross-sectional surface area within a tolerance range of ±10%.

3. A shank according to claim 1, wherein at least one of the opposite ends of the at least one locking groove (3) has one of a spherical and cylindrical axial stop surface (6) engageable by the locking member (4) having, respectively, one of a spherical and cylindrical shape.

4. A shank according to claim 1, further comprising a second, radially projecting, entrain strip (2) located diametrically opposite the at least one entrain strip, wherein a bottom surface of the at least one locking groove (3), which is located between the at least one and second entrain strips (2), forms a first functional surface (7*a*, 7*b*) formed of smooth surface sections exhibiting one of a smooth transition and a sharp edge transition, with a transition region being curved in a direction to a tool axis.

5. A shank according to claim 4, wherein the smooth surface sections are even.

6. A shank according to claim 4, further comprising a second locking groove arranged diametrically opposite the at least one locking groove, with a bottom surface of the second groove, which is located between the at least one and second entrain strips, forming a second functional surface (7*a*, 7*b*) located opposite the first functional surface.

7. A shank according to claim 1, wherein the at least one guide region (1*a*, 1*b*) has a cylindrical outer surface.

8. A shank according to claim 1, wherein a second entrain strip (2), which is arranged diametrically opposite the at least one entrain strip, is provided in the axial region (A) of the at least one locking groove.

9. A shank according to claim 1, further comprising a second locking groove (3) arranged diametrically opposite the at least one locking groove and having a same shape.

10. A shank according to claim 9, further comprising a second entrain strip arranged diametrically opposite the at least one entrain strip in the axial region (A) of the locking grooves.

11. A shank according to claim 1, comprising further axial regions axially spaced from each other and arranged one of parallel to each other, crosswise to each other, and at an acute angle (β) to each other.

12. A shank according to claim 11, further comprising a third guide region (1*c*) arranged between the axial regions (A, $A^1$).

13. A shank according to claim 12, further comprising a further, segment-shaped guide region (1*d*) provided between the locking grooves (3) and the entrain strips (2).

14. A shank according to claim 1, wherein at the guide dimension (F) of the guide region (1*a*, 1*b*), the width (B) amounts to from the guide dimension (F) multiplied by 1.2 to the guide dimension (F) multiplied by 1.4, and the thickness (D) amounts to from the guide dimension (F) multiplied by 0.6 to the guide dimension (F) multiplied by 0.8.

15. A shank according to claim 1, wherein the shank comprises a second entrain strip (2) located diametrically opposite the at least one entrain strip, the at least one entrain strip (2) and the second entrain strip (2) being located in the axial region of the at least one locking groove.

16. A tool set, comprising:

a chuck; and a first tool having:

a shank having at least two, axially spaced, guide regions (1*a*, 1*b*);

at least one radially projecting entrain strip (2) arranged between the at least two guide regions (1*a*, 1*b*); and at least one locking groove (3) arranged between the at least two guide regions (1*a*, 1*b*), the at least one locking groove being axially closed at opposite ends thereof, and adapted to receive at least one radially displaceable and axially displaceable, within predetermined limits, locking member (4) of the chuck, with the two guide regions (1*a*, 1*b*) having identical diameters equal to a guide dimension (F), and an axial region (A) of the locking groove (3) having a cross-sectional width (B) that includes a radial extent of the entrain strip (2), and a thickness (D) measured in a direction transverse to width measurement direction, and with the guide dimension (F) being greater than the thickness (D) but smaller than the width (B); and a second tool having a similar shank, wherein the axial region (A) of the shank of the first tool has a thickness/width ratio greater than a thickness/width ratio of the axial region (A) of the shank of the second tool, and wherein a maximum aperture angle (α) of a bottom surface of the at least one locking groove (3), which is defined by a cross-section of the axial region (A) of the at least one locking groove (3), amounts to 180°.

17. A shank according to claim 16, wherein each of the shanks of the first and second tools has a second entrain strip located diametrically opposite the at least one entrain strip, the at least one and second entrain strips of each shank being located in the axial region of a respective shank.

18. A chuck comprising:

a chuck sleeve for receiving a shank of a tool with the shank having:

at least two, axially spaced, guide regions (1*a*, 1*b*);

at least one radially projecting entrain strip (2) arranged between the at least two guide regions (1*a*, 1*b*); and at least one locking groove (3) arranged between the at least two guide regions (1*a*, 1*b*), the at least one locking groove being axially closed at opposite ends thereof, and adapted to receive at least one radially displaceable and axially displaceable, within predetermined limits, a locking member (4) of the chuck, with the at least two guide regions (1*a*, 1*b*) having identical diameters equal to a guide dimension (F), and an axial region (A) of the locking groove (3) has a cross-sectional width (B) that includes a radial extent of the entrain strip (2) and a thickness (D) measured in a direction transverse to the width measurement direction, and with the guide dimension (F) being greater than the thickness (D) but smaller than the width (B), wherein a maximum aperture angle (α) of a bottom surface of the at least one locking groove (3), which is define by a cross-section of the axial region (A) of the at least one locking groove (3), amounts to 180;

the chuck sleeve including two axially spaced inner guide surfaces cooperating with the respective guide regions of the shank;

the at least one locking member (4) being radially displaceable over a distance smaller than a half (F/2) of the guide dimension (F) of the guide region of the shank; and at least one rotation-transmitting element (5) circumferentially offset relative to the locking member (4) and having a radial extent, with respect to a tool axis (L) greater than a half (F/2) of the guide dimension (F).

* * * * *